United States Patent [19]

Tanaka

[11] Patent Number: 4,957,189

[45] Date of Patent: Sep. 18, 1990

[54] LIFTING DEVICE

[76] Inventor: Kenjiro Tanaka, 12-30 Chuo 3-chome, Kofu-shi, Yamanashi-ken, Japan

[21] Appl. No.: 396,083

[22] Filed: Aug. 18, 1989

[30] Foreign Application Priority Data

Feb. 18, 1988 [JP] Japan ..... 63-35567

[51] Int. Cl.[5] ..... B66B 9/06

[52] U.S. Cl. ..... 187/12; 187/19; 187/20; 187/95; 104/127; 182/2; 414/595

[58] Field of Search ..... 187/1 R, 10, 12, 14, 187/17, 19, 20, 25, 81, 82, 83, 93, 94, 95; 182/2; 104/127, 128, 129, 164; 414/10, 458, 459, 595, 681

[56] References Cited

U.S. PATENT DOCUMENTS 500,992 7/1893 Carr ..... 187/12 X
2,588,959 3/1952 Campbell ..... 187/10
4,183,423 1/1980 Lewis ..... 187/10 X
4,257,491 3/1981 Presnall, Jr. et al. ..... 187/6 X
4,821,845 4/1989 DeViaris ..... 187/12

FOREIGN PATENT DOCUMENTS 47-016931 5/1972 Japan .

*Primary Examiner*—Joseph J. Rolla
*Assistant Examiner*—Dean A. Reichard
*Attorney, Agent, or Firm*—Kanesaka & Takeuchi

[57] ABSTRACT

A lifting device which includes an outer rail composed of an outer vertical section, and an outer inclined section, an outer horizontal section; an inner rail composed of an inner vertical section, an inner inclined section, and an inner horizontal section; the outer and inner rails forming a railway; a carrier having four rollers fitted between the outer and inner rails; and the relationship between the rollers and the railway being such that the carrier keeps a constant posture while it is being guided along the railway.

14 Claims, 4 Drawing Sheets

LIFTING DEVICE

BACKGROUND OF THE INVENTION

The present invention relates to a lifting device which is able to lift and draw a load along a single or pair of railways.

Japanese Patent Kokoku No. 47-16931 discloses a forklift with a platform guided along four railways.

In the above forklift, however, it is necessary to provide two pairs of railways for each platform so that when a number of platforms are desired, it is difficult and expensive to make such a forklift. Even if it is made, the resulting forklift is bulky and clumsy.

SUMMARY OF THE INVENTION

Accordingly, it is an object of the invention to provide a lifting device capable of pulling up and drawing in an object with a single or pair of railways.

In accordance with the present invention there is provided a lifting device which includes an outer rail composed of an outer vertical section, an outer inclined section, and an outer horizontal section, said outer vertical and inclined sections made intergral via a first outer curve section and a second outer curve section, and said outer inclined and horizontal sections made integral via a third outer curve section; an inner rail composed of an inner vertical section, an inner inclined section, and an inner horizontal section, said inner vertical and inclined sections made integral via a first inner curve section, and said inner inclined and horizontal sections made integral via a second inner curve section; a carrier having an upper front roller, a lower front roller, an upper rear roller, and a lower rear roller, said carrier movably fitted into between said outer and inner rails.

Other objects, features, and advantages of the invention will be apparent from the following description when taken in conjunction with the accompanying drawings.

DESCRIPTION OF THE PREFERRED EMBODIMENT

Figure 1:
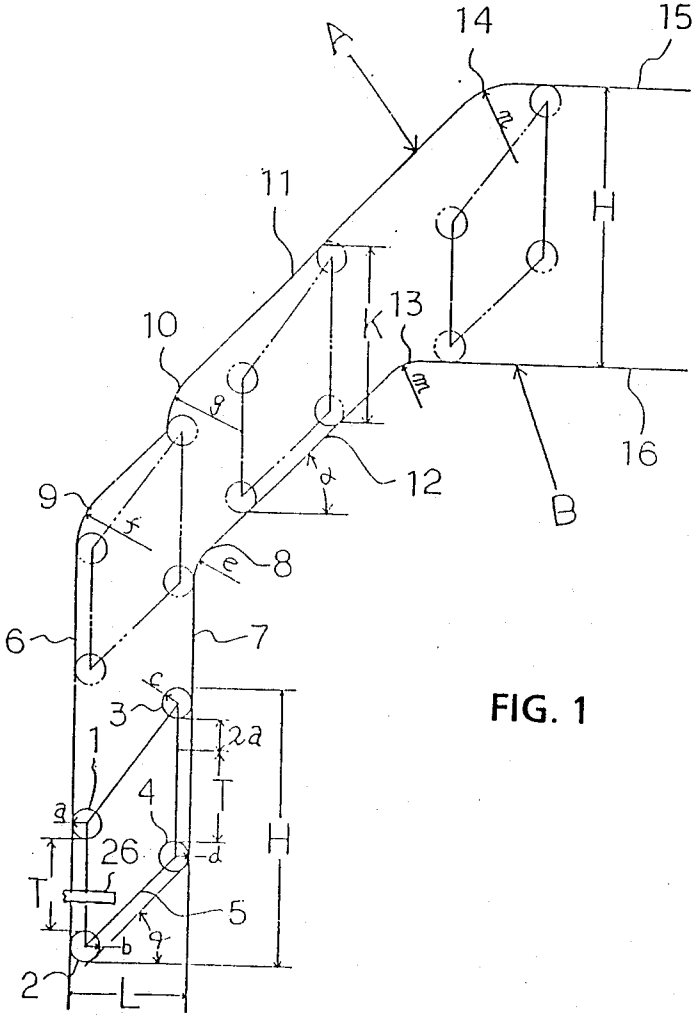
FIG. 1 is a schematic diagram showing a working principle of a lifting device according to an embodiment of the invention.

In FIG. 1, an upper front roller 1 with a radius, a, and a lower front roller 2 with a radius, b, are mounted on opposite ends of the front vertical side of a carrier 5 with parallel vertical sides. A lower rear roller 4 with a radius, d, is mounted on the lower end of a rear vertical side. The line contacts these two lower rollers makes an angle, alpha, to a horizontal line. An upper rear roller 3 with a radius, c, is mounted on the upper end of the rear vertical side. The distance between the two rear rollers 3 and 4 is equal to the sum of the distance between the two front rollers 1 and 2, T, and the diameter of the upper front roller 1, ($2\times a$). The upper front roller 1 is mounted at a position higher than that of the lower rear roller 4. A platform 26 is attached to the carrier 5.

An outer rail A has an outer vertical section 6, an outer inclined section 11, and an outer horizontal section 15. The outer vertical section 6 and the outer inclined section 11 are made integral via outer curve sections 9 and 10. The outer inclined section 11 and the outer horizontal section 15 are made integral via an outer curve section 14.

An inner rail B has an inner vertical section 7, an inner inclined section 12, and an inner horizontal section 16. The inner vertical section 7 and the inner inclined section 12 are made integral via an inner curve section 8, while the inner inclined section 12 and the inner horizontal section 16 are made integral via an inner curve section 13.

The radius of the outer curve section 9, f, is $f=c+d+a$, the radius of the outer curve section 10, g, is $g=e+d+c$, and the radius of the outer curve section 14, n, is $n=m+b+c$, wherein a is the radius of the upper front roller 1, b the radius of the lower front roller 2, c the radius of the lower rear roller 3, d the radius of the upper rear roller 4, e the radius of the inner curve section 8, and m the radius of the inner curve section 13.

The outer and inner vertical sections 6 and 7 are separated in parallel by the distance L defined by the front and rear rollers 2 and 4. The outer and inner inclined sections 11 and 12 are inclined by the same angle, alpha, as that of the lower inclined side of the carrier 5 and separated by the distance K defined by two points; the point where the upper rear roller 3 contacts the outer inclined section 11 and the point where the lower rear roller 4 contacts the inner inclined section 12. The outer and inner horizontal sections 15 and 16 are separated by the distance H defined by the upper rear and lower front rollers 3 and 2.

In the vertical rail section, the load is applied to the point where the upper front roller 1 contacts the outer vertical section 6 and the point where the lower rear roller 4 contacts the inner vertical section 7 so that the carrier 5 and the platform 26 are kept horizontal during the vertical running section.

In the curved rail section, when the upper front roller 1 and the lower rear roller 4 enter the curved sections 9 and 8, respectively, the upper rear roller 3 enters the curved section 10 so that the load is transferred to the upper rear roller 3. Consequently, the carrier 5 and the platform 26 are kept horizontal during running along the curved section, with the load applied to the point where upper rear roller 3 contacts the outer curve section 10 and the point where lower rear roller 4 contacts the inner curve section 8.

Then, the carrier 5 and the platform 26 are run along the inclined section with the carrier 5 and the platform 26 kept horizontal while the load is applied to the point where the upper rear roller 3 contacts the outer inclined section 11 and the point where the lower rear roller 4 contacts the inner inclined section 12. When the lower rear roller 4 leaves the inner inclined section 12, the load is transferred to the lower front roller 2 from the lower rear roller 4 so that the carrier 5 continues to run along the inclined rail section with the load applied to the upper rear roller 3 and the lower front roller 2.

When the upper rear roller 3 and the lower front roller 2 enter the curved sections 14 and 13, respectively, the carrier 5 is run along the curved section then the horizontal section with the platfrom 26 kept horizontal while the load is applied to the point where the upper rear roller 3 contacts the outer curve section 14 and the point where the lower front roller 2 contacts the inner curve section 13.

In the horizontal rail section, the carrier 5 is run with the platform 26 kept horizontal while the load is applied to the point where upper rear roller 3 contacts the outer horizontal section 15 and the point where the lower front roller 2 contacts the inner horizontal section 16. In this way, it is possible to drive the carrier 5 along the vertical, inclined, and horizontal rail sections, with the platform 26 always kept horizontal.

Figure 3:
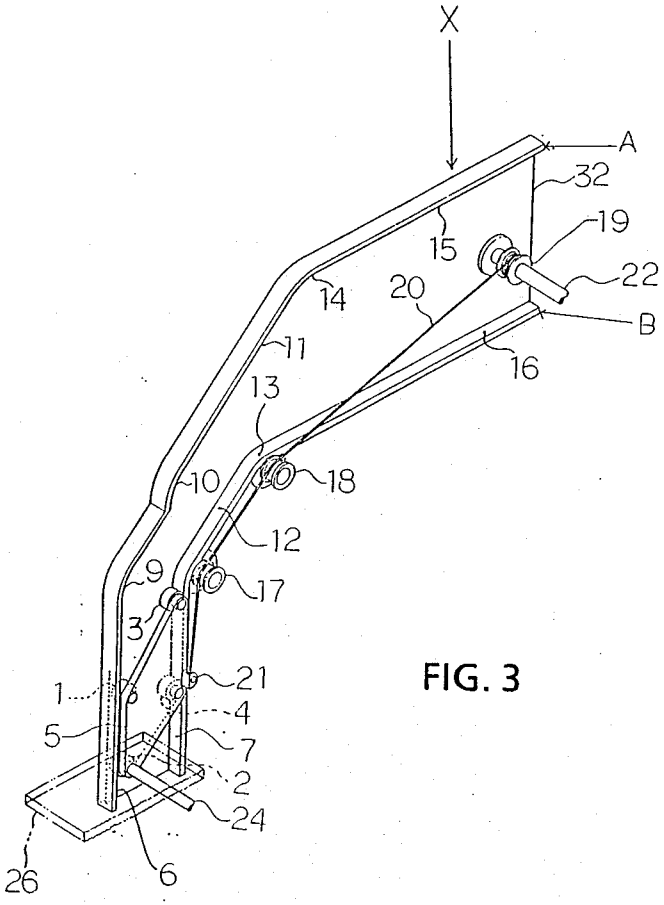
FIG. 3 is a perspective sectional view taken along the line R—R of FIG. 2.
Figure 2:
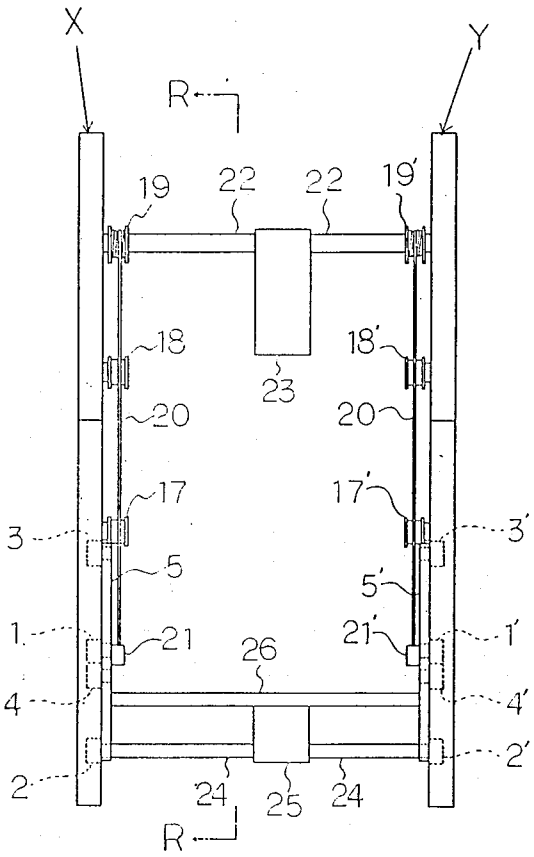
FIG. 2 is a front elevational view of a lifting device according to an embodiment of the invention.

In FIG. 2 and 3, a pair of left and right railways X and Y are erected in parallel. Each railway has outer and inner rails A and B secured to a side wall 32. The left railway X guides a left carrier 5 with four rollers 1–4 while the right railway Y guides right carrier 5' with four rollers 1'–4'. A platform 26 is secured at opposite ends to the carrier 5 and 5'. A driving unit 25 mounted on the underside of the platform 26 has a driving shaft 24 which is connected at opposite ends to the lower front rollers 2 and 2'.

A driving unit 23 with a driving shaft 22 is mounted toward the end of the horizontal railway section. The driving shaft 22 has a pair of drums 19 and 19'. An end of a wire 20 is attached to each drum 19 and the other end is attached to the wire attachment 21 which is secured to the lower rear portion of the carrier 5. Guide rollers 17 and 18 are mounted on the side wall 32 beneath the curved sections 8 and 13, respectively. Similarly, guide rollers 17' are 18' and mounted on the right side wall of the right railway Y.

When the driving unit 23 is put into operation to turn the drums 19 and 19' for winding the wires 20 and 20' via the guiding rollers 17, 18 and 17', 18', the carriers 5 and 5' are moved upward along the vertical, inclined, and horizontal railway sections, with the platform 26 kept horizontal.

When the platform 26 is lowered, the driving units 23 and 25 are put into operation so that the carriers 5 and 5' are moved with the driving lower front rollers 2 and 2' in the horizontal railway section and by gravity in the inclined and vertical railway sections under control of the driving unit 23.

With this lifting device, it is also necessary to provide a pair of railways. In addition, the carrier with rollers is fitted into the railway, giving a streamlined structure, so that this lifting device is especially useful for moving the high drawer of a wardrobe or the like where good appearance is required.

Figure 4:
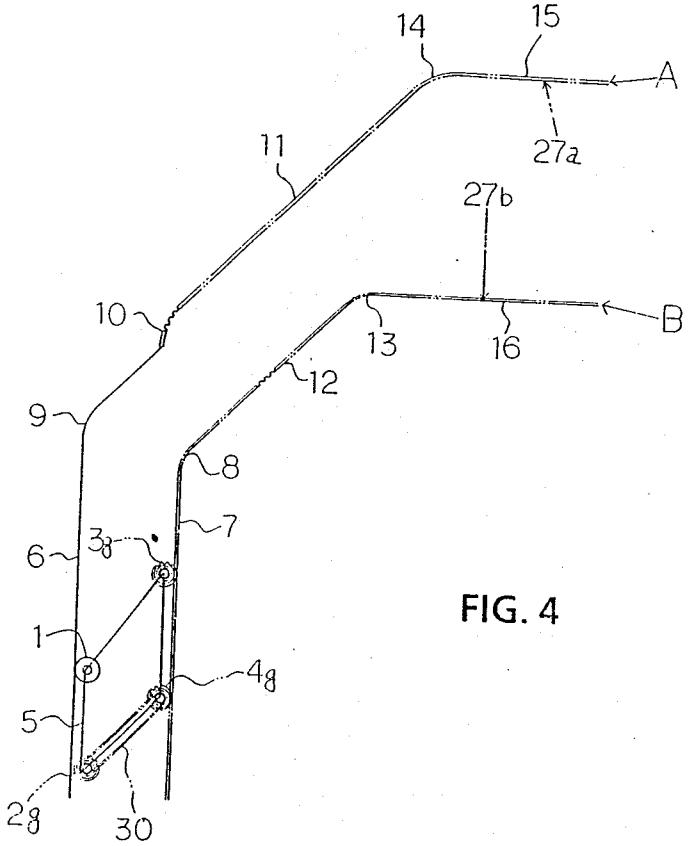
FIG. 4 is a schematic diagram showing a working principle of lifting devices according to other embodiments of the invention.

In FIG. 4, this lifting device is the same as the above except that the rail is made in the form of a rack and the rollers are replaced with pinions which are driven to move the carrier. For example, the entire length of the inner rail B is made in the form of a rack while the lower front roller 2 is replaced with a pinion **2*g* and the lower rear roller 4 is replaced with a pinion 4*g*. The pinions 2*g* and 4*g* are driven by the driving unit, and the pinion 2*g* is kept from contacting the outer vertical rail section. Thus, the carrier is moved by the driving lower rear roller 4*g* in the vertical rail section 7, the curved section 8, and the first half of the inclined rail section 12 and by the driving lower front roller 2*g* in the second half of the inclined rail section 12, the curved section 13, and the horizontal rail section 16**.

Figure 6:
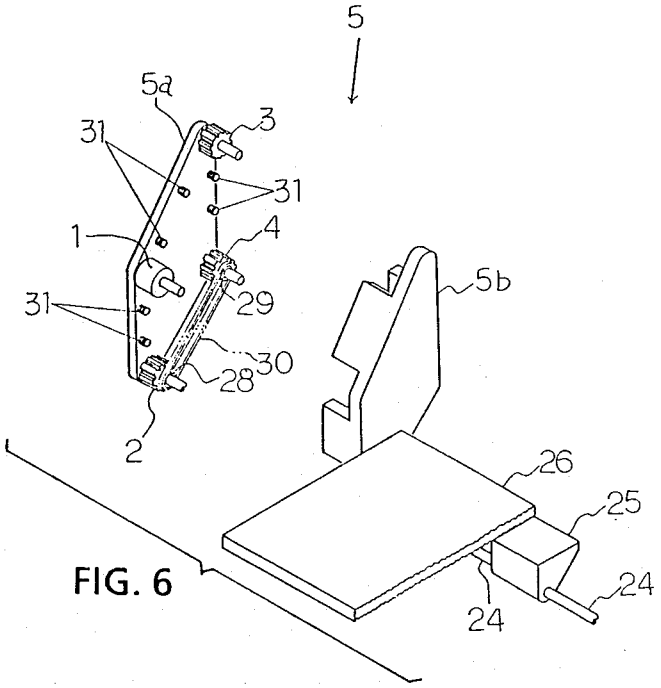
FIG. 6 is an exploded perspective view of a carrier useful for the lifting device of FIG. 5.
Figure 7:
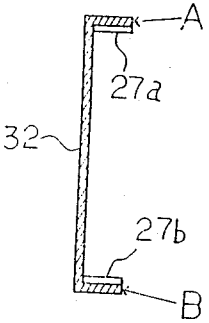
FIG. 7 is a cross section of a horizontal rail section useful for the lifting device of FIG. 5.
Figure 5:
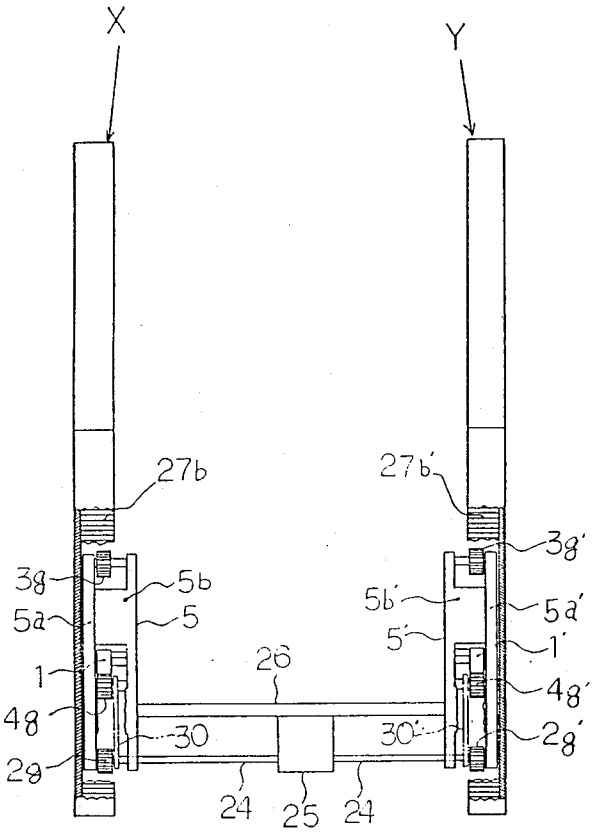
FIG. 5 is a partially cutaway front elevational view of a lifting device according to another embodiment of the invention.

In FIGS. 5–7, a pair of railways X and Y are erected in parallel. The left railway X has outer and inner rails A and B which are secured to a side wall 32 (FIG. 7). The outer curve section 10, the outer inclined section 11, the outer curve section 14, and the outer horizontal section 15 are made in the form of a rack, whereas the entire length of the inner rail B in made in the form of a rack.

A platform 26 connects a left carrier 5 fitted into the left railway X and a right carrier 5' fitted into the right railway Y. A driving unit 25 mounted on the underside of the platform 26 has a driving shaft 24, opposite ends of which are attached to the driving rollers **2*g* and 2*g'***.

An inner carrier section **5*a* and an outer carrier section 5*b* are joined together with bolts 31 to complete the carrier 5, which has an upper front roller 1 at the upper front corner, a lower front pinion 2*g* at the lower front corner, an upper rear pinion 3*g* at the upper rear corner, and a lower rear pinion 4*g* at the lower rear corner. A front sprocket 28 is attached to a side of the lower front pinion 2*g* while a rear sprocket 29 is attached to a side of the lower rear pinion 4*g*. A loop of chain 30 is put on the sprockets 28 and 29. The right carrier 5' has a similar structure to that of the left carrier 5**.

When the driving unit 25 is put into operation to turn the lower front pinions **2*g* and 2*g'* via the driving shaft 24, the lower rear pinions 4*g* and 4*g'* are turned via the chains 30 and 30'. Since the pinions 4*g* and 4*g'* mesh with the vertical rack sections 7, the carriers 5 and 5' are moved upward with the platform 26** kept horizontal. With this lifting device, it is not necessary to use any wires, guide rollers, and driving units mounted toward the end of the horizontal rail section, thus providing a more streamlined appearance.

Figure 10:
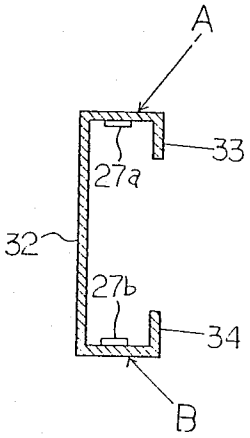
FIG. 10 is a cross section of a horizontal rail section useful for the lifting device of FIG. 8.
Figure 9:
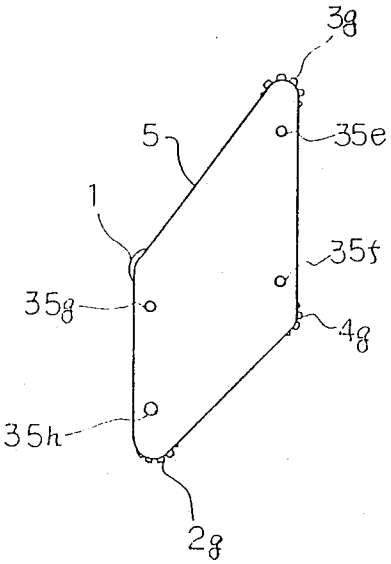
FIG. 9 is a side elevational view of a carrier useful for the lifting device of FIG. 8.
Figure 8:
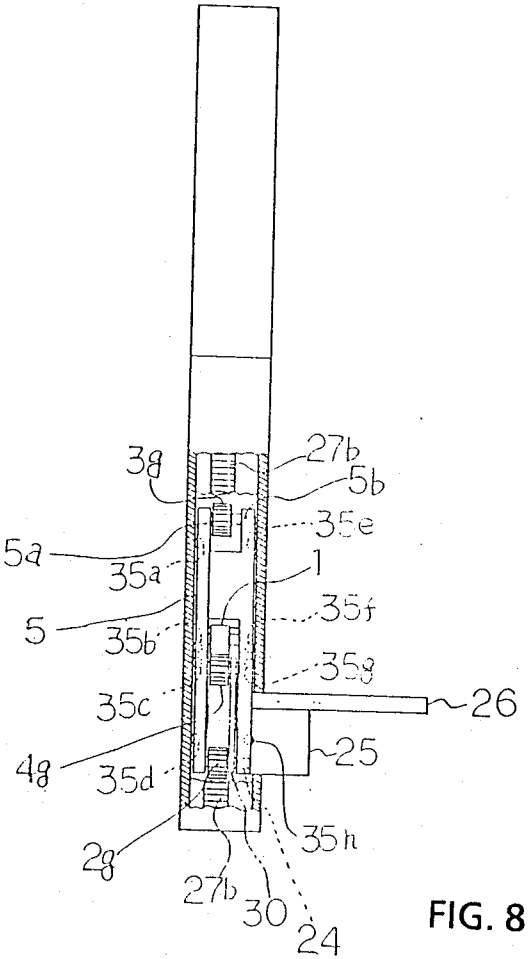
FIG. 8 is a partially cutaway front elevational view of a lifting device according to still another embodiment of the invention.

In FIGS. 8–10, outer and inner rails A and B are secured to a side wall 32 (FIG. 10). The outer rail A has an outer flange 33 extending to the inner rail B while the inner rail B has an inner flange 34 extending to the outer rail A. The curved rail section 10, the outer inclined rail section 11, the curved rail section 14, and the outer horizontal rail section 15 are made in the form of a rack **27*a*, while the entire length of the inner rail B is made in the form of a rack 27*b***.

Four spherical rollers **35*a*–35*d* are rotatably mounted on the inner carrier section 5*a*; the upper rear spherical roller 35 *a* is positioned below the upper rear pinion 3*g*, the lower rear spherical roller 35*b* above the lower rear pinion 4*g*, the upper front spherical roller 35*c* below the upper front roller 1, and the lower front spherical roller 35*d* above the lower front pinion 2*g*. The similarly, four spherical rollers 35*e*–35*h* are mounted on the outer carrier section 5*b*; the upper rear spherical roller 35*e* is positioned below the upper rear pinion 3*g*, the lower rear spherical roller 35*f* above the lower rear pinion 4*g*, the upper front spherical roller 35*g* below the upper front roller 1, and the lower front spherical roller 35***h* above the lower front pinion 2*g*.

When the carrier 5 is fitted into the railway, the inside spherical rollers 35*a*–35*d* contact the side wall 32. When the carrier 5 is moved upward, the outside rear spherical rollers 35 *e* and 35*f* contact the inner flange 34 while the outside front spherical rollers 35*g* and 35*h* contact the outer flange 33. While the carrier is moved along the inclined rail section, the upper rear spherical roller 35*e* contacts the outer flange 33 while both or either of the lower rear and front spherical rollers 35*f* and 35*h* contacts the inner flange 34. While the carrier is moved along the horizontal rail section, the upper rear spherical roller 35*e* contacts the outer flange 33 and the lower front spherical roller 35*h* contacts the inner flange 34.

The platform 26 is kept horizontal by the spherical rollers 35*e*, 35*g* and 35*b*, 35*d* in the vertical rail section, by the spherical rollers 35*e* and 35*b*, 35*d* in the inclined rail section, and by the spherical rollers 35*e* and 35*d* in the horizontal rail section. This lifting device is similar to that of FIG. 5 except for the addition of spherical rollers to the carrier and flanges to the rails.

Figure 11:
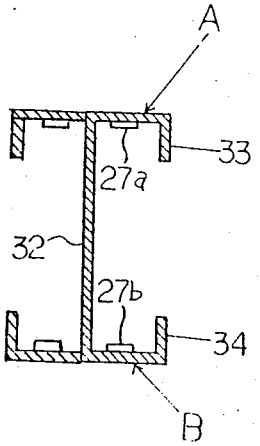
FIG. 11 is a cross section of a horizontal rail section according to yet another embodiment of the invention.

The lifting device according to this embodiment requires only a single railway, making the installation work more efficient. In addition, a pair of platforms may be mounted on opposite sides of a single railway by making it symmetrical with respect to the side wall 32 as shown in FIG. 11.

As have been decribed above, the lifting devices according to the first and second embodiments require only a pair of railways and have a streamlined structure compared with the conventional ones so that a number of platforms may be mounted side by side by merely installing a row of railway assemblies in which a pair of railways are secured on opposite sides of each side wall except for the railway assemblies at both ends of the row, thus making the installation work more efficient as well as saving the installation space.

The lifting device according to the third embodiment requires only one railway, making not only the installation possible in a limited space but also the installation work further efficient. In addition, it is possible to mount a pair of platforms on opposite sides of a railway in which an outer rail A with a pair of outer flanges 33 on either edge thereof and an inner rail B with a pair of inner flanges 34 on either edge thereof.

Since the length of the respective rail sections and the angle of the inclined rail section may be changed and/or a combination of the vertical and inclined rail sections or a combination of the inclined and horizontal rail sections may be employed to make a railway, the lifting device according to the invention is so flexible to be used for a variety of applications.

I claim:

1. A lifting device comprising:

an outer rail composed of an outer vertical section, an outer inclined section, and an outer horizontal section, said outer vertical and inclined sections made integral via a first outer curve section and a second outer curve section, and said outer inclined and horizontal sections made integral via a third outer curve section;

an inner rail composed of an inner vertical section, an inner inclined section, and an inner horizontal section, said inner vertical and inclined sections made integral via a first inner curve section, and said inner inclined and horizontal sections made integral via a second inner curve section; and a carrier having an upper front roller, a lower front roller, an upper rear roller, and a lower rear roller, said carrier movably fitted between said outer and inner rails.

2. The lifting device of claim 1, wherein the distance between said two rear rollers is equal to the sum of the distance between said two front rollers and the diameter of said upper front roller.

3. The lifting device of claim 1, wherein the angle of said inner inclined section with respect to a horizontal line is equal to that of a lower inclined side of said carrier with respect to a horizontal line.

4. The lifting device of claim 1, wherein said upper front roller is placed at a position higher than that of said lower rear roller.

5. The lifting device of claim 1, wherein said outer rail has a pair of outer flanges extending toward said inner rail from opposite edges thereof and said inner rail has a pair of inner flanges extending toward said outer rail from opposite edges thereof.

6. The lifting device of claim 1, wherein said outer rail has an outer flange extending toward said inner rail and said inner rail has an inner flange extending toward said outer rail.

7. The lifting device of claim 6, wherein said carrier has spherical rollers on inner and outer carrier sections.

8. A lifting device comprising:

an outer rail including an outer vertical section, an outer inclined section, and an outer horizontal section, said outer vertical and inclined sections made integral via a first outer curve section and a second outer curve section, and said outer inclined and horizontal sections made integral via a third outer curve section;

an inner rail including an inner vertical section, an inner inclined section, and an inner horizontal section, said inner vertical and inclined sections made integral via a first inner curve section, and said inner inclined and horizontal sections made integral via a second inner curve section;

means for integrating said outer and inner rails to form a railway;

a carrier with front and rear vertical sides having an upper front roller and lower front roller mounted on either end of said front vertical side, and an upper rear roller and a lower rear roller mounted on said rear vertical side, said carrier movably fitted between said outer and inner rails;

a platform secured to said carrier at one side , on which a load may be put; and means for driving said carrier along said railway so that said platform is carrier along said railway while being kept always horizontal.

9. The lifting device of claim 8, wherein said integration means takes the form of a side wall.

10. The lifting device of claim 8, wherein said driving means comprises:

a driving unit provided toward an end of said outer and inner horizontal sections;

a driving shaft connected to said driving unit;

a drum fitted over said driving shaft at an end portion; and a wire connected to said drum at an end and said carrier at the other end.

11. The lifting device of claim 8, wherein said driving means comprises:

a first driving unit provided toward an end of said outer and inner horizontal sections;

a first driving shaft connected to said driving unit;

a drum fitted over said driving shaft at an end portion;

a wire connected to said drum at an end and said carrier at the other end;

a second driving unit mounted on said platform;

a second driving shaft connecting said lower front roller to said second driving unit;

12. The lifting device of claim 8, wherein at least part of said rail is made in the form of the rack and part of said rollers are made in the form of a pinion.

13. The lifting device of claim 12, wherein said driving means comprises: a lower front pinion and a lower rear pinion;

a driving unit mounted on said platform;

a driving shaft connecting said driving unit to said lower front pinion; and means for transmitting power from said lower front pinion to said lower rear pinion.

14. The lifting device of claim 13, wherein said transmitting means is a loop of chain.

* * * * *